US005778610A

United States Patent [19]

Berg

[11] Patent Number: 5,778,610

[45] Date of Patent: Jul. 14, 1998

[54] MODULAR STAIR JACK SYSTEM

[76] Inventor: Thomas L. Berg, 12527 38th Ave. SE, Everett, Wash. 98204

[21] Appl. No.: 829,438

[22] Filed: Mar. 28, 1997

[51] Int. Cl.[6] ..... E04F 11/00

[52] U.S. Cl. ..... 52/182; 52/105; 52/188; 52/191

[58] Field of Search ..... 52/182, 183, 188, 52/191, 105

[56] References Cited

U.S. PATENT DOCUMENTS

| | | | |
|---|---|---|---|
| 569,464 | 10/1896 | Moore | 52/188 |
| 2,021,457 | 11/1935 | MacKenzie | 52/191 |
| 3,196,997 | 7/1965 | Hager | 52/182 |
| 4,635,416 | 1/1987 | Ayala | 52/188 |
| 4,866,894 | 9/1989 | Brown | 52/191 X |
| 4,875,315 | 10/1989 | Champagne | 52/191 X |
| 5,205,093 | 4/1993 | Schuette | 52/191 X |
| 5,293,722 | 3/1994 | Reimann | 52/188 X |
| 5,636,483 | 6/1997 | Willie | 52/188 |

*Primary Examiner*—Robert Canfield
*Attorney, Agent, or Firm*—Seed and Berry LLP

[57] ABSTRACT

A stair jack for constructing a staircase between an upper surface and a lower surface. The stair jack has a stair support member with a top inclined edge and a plurality of tread supports adapted to be fixedly coupled to the stair support member. Each tread support has a riser surface that projects upwardly from the top inclined surface and a trend support surface extending from the top inclined surface to an upper point of the riser surface. Stair treads and risers are affixed to the tread supports and riser surfaces, respectively, so as to form a staircase in which both the stringer and the tread support members are hidden from view.

14 Claims, 4 Drawing Sheets

MODULAR STAIR JACK SYSTEM

TECHNICAL FIELD

The present invention is directed toward an apparatus and method for constructing a staircase.

BACKGROUND OF THE INVENTION

Staircases are typically constructed at a job site in accordance with the design specifications of the specific structure. FIG. 1 illustrates a conventional staircase I that has two stringers 2 (only one is shown) formed by cutting a plurality of tread surfaces 4 and riser surfaces 6 in a board 3 (e.g., a 2×12 or 2×10 piece of wood). The stringers 2 are positioned between a lower floor 8 and an upper floor 10, and a tread 14 is fixed to each tread surface 4. Additionally, interior staircases typically have a riser 16 fixed to each riser surface 6.

Conventional staircases are generally difficult and time-consuming to lay out and construct. Building codes require that the treads 14 have a minimum width W (e.g., 10 inches). Carpenters must accordingly lay out each staircase 1 by determining a riser height H that will result in steps with at least the minimum tread width and the same riser height H for the full height h of the staircase. After a carpenter lays out the staircase, the carpenter then removes excess material (shown shaded in FIG. 1) from the board 3. Part of the excess material is removed by cutting notches in the board 3 to form the tread surfaces 4 and riser surfaces 6. Thus, one drawback of conventional staircases is that it is time-consuming to lay out and cut the notches in the board 3 to ensure that each step has a uniform height H and the minimum tread width W. A further drawback of conventional staircases is that the notches weaken the structural integrity of the stringer 2, and therefore the stringer 2 must be made from large, expensive boards 3 to ensure that the stringers do not fail. Thus, conventional methods and devices limit the efficiency with which a staircase may be constructed.

One existing apparatus and method for addressing some of the drawbacks of conventional staircases is disclosed in U.S. Pat. No. 4,819,391 to Tassin et al. U.S. Pat. No. 4,819,391, more specifically, discloses a stair bracket formed from a single strip of sheet metal that is used for constructing a staircase. The bracket disclosed in Tassin et al. has a tread portion and a riser portion, and both the tread portion and the riser portion are mounted to a stringer so that the tread portion is completely below a top inclined edge of the stringer. As a result, treads and risers mounted to the brackets disclosed in Tassin et al. cannot easily be made flush with a wall or kickboard against which the stringer is placed. Furthermore, the bracket disclosed in Tassin et al. has a front edge at each riser portion that may be visible after the riser is installed. Thus, the bracket disclosed in Tassin et al. may be aesthetically unappealing for use in highly fashionable stairways in which the risers or the kickboards are exposed.

SUMMARY OF THE INVENTION

The present invention is an apparatus and method to construct a stair jack for a staircase. In one embodiment, the stair jack has a stair support member with a top inclined edge, and a plurality of tread supports adapted to be fixedly coupled to the stair support member. The stair support member has a length sufficient to extend between an upper surface and a lower surface. Each tread support has a riser surface that projects upwardly from the top inclined edge of the stair support member and a tread mounting surface that extends from an upper point of the riser surface to the top inclined edge of the stair support member. As a result, at least a portion of the tread mounting surface is above the top inclined edge of the stair support member. Each tread mounting surface may support a stair tread such that the stair tread abuts a wall or kickboard located adjacent to the stair support member. Additionally, a riser may be attached to the riser surface to completely cover the riser surface and form an aesthetically pleasing stairway.

In another embodiment of the invention, a modular stair jack system has a plurality of tread mounts that are adapted to be individually attached to a stringer. Each tread mount may have an attachment element to fixedly attach the tread mount to a surface of the stringer, a riser element extending upwardly from a lower point of the attachment element, and a tread element extending from an upper point of the riser element to an upper point of the attachment element. The attachment element is configured to attach the tread mount to the stringer so that at least a portion of the riser element extends above a top inclined surface of the stringer for a desired step height, and at least a portion of the tread element extends above the top inclined surface of the stringer in a manner to support a stair tread having a desired width. The tread mount may be a bracket or a block. In one embodiment, for example, the tread mount is a substantially rectangular block in which a first surface projects above the top inclined edge of the stringer to form the riser element and a second surface normal to the first surface forms the tread element.

DETAILED DESCRIPTION OF THE INVENTION

Figure 1:
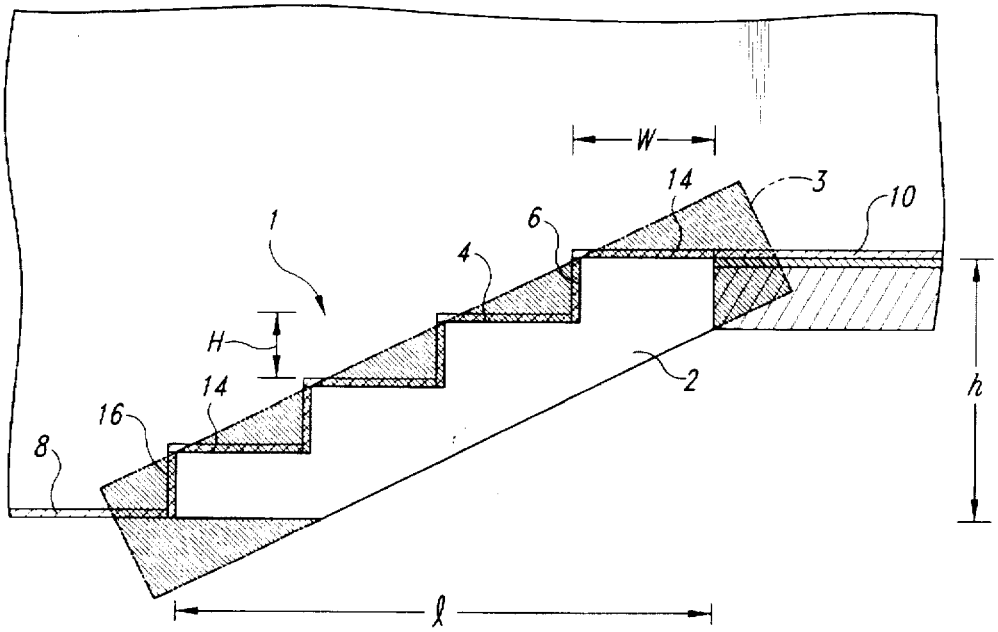
Fig. 1 (Prior Art)
FIG. 1 is a side view of a conventional stair jack in accordance with the prior art.
Figure 2:
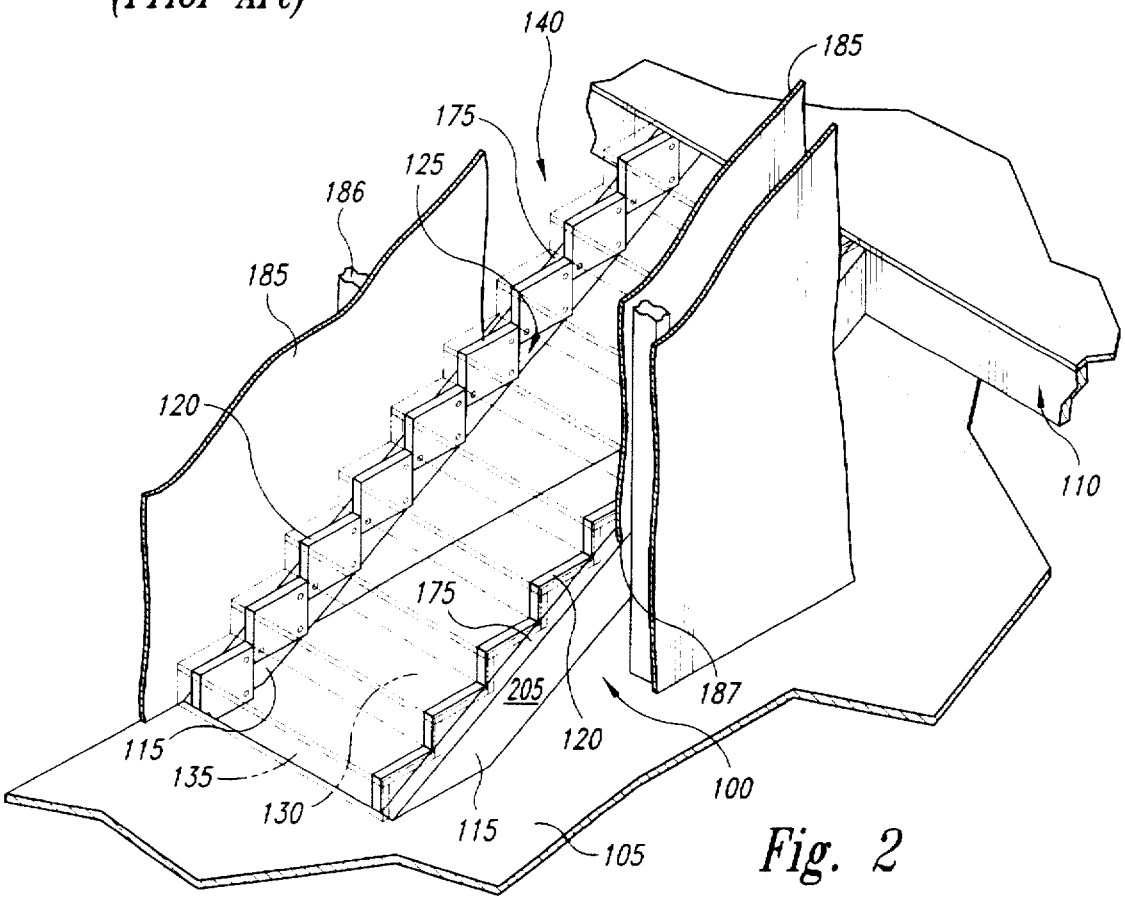
FIG. 2 is an isometric view of an embodiment of a pair of stair jacks in accordance with the invention positioned between two walls and extending between an upper and lower floor.
Figure 3:
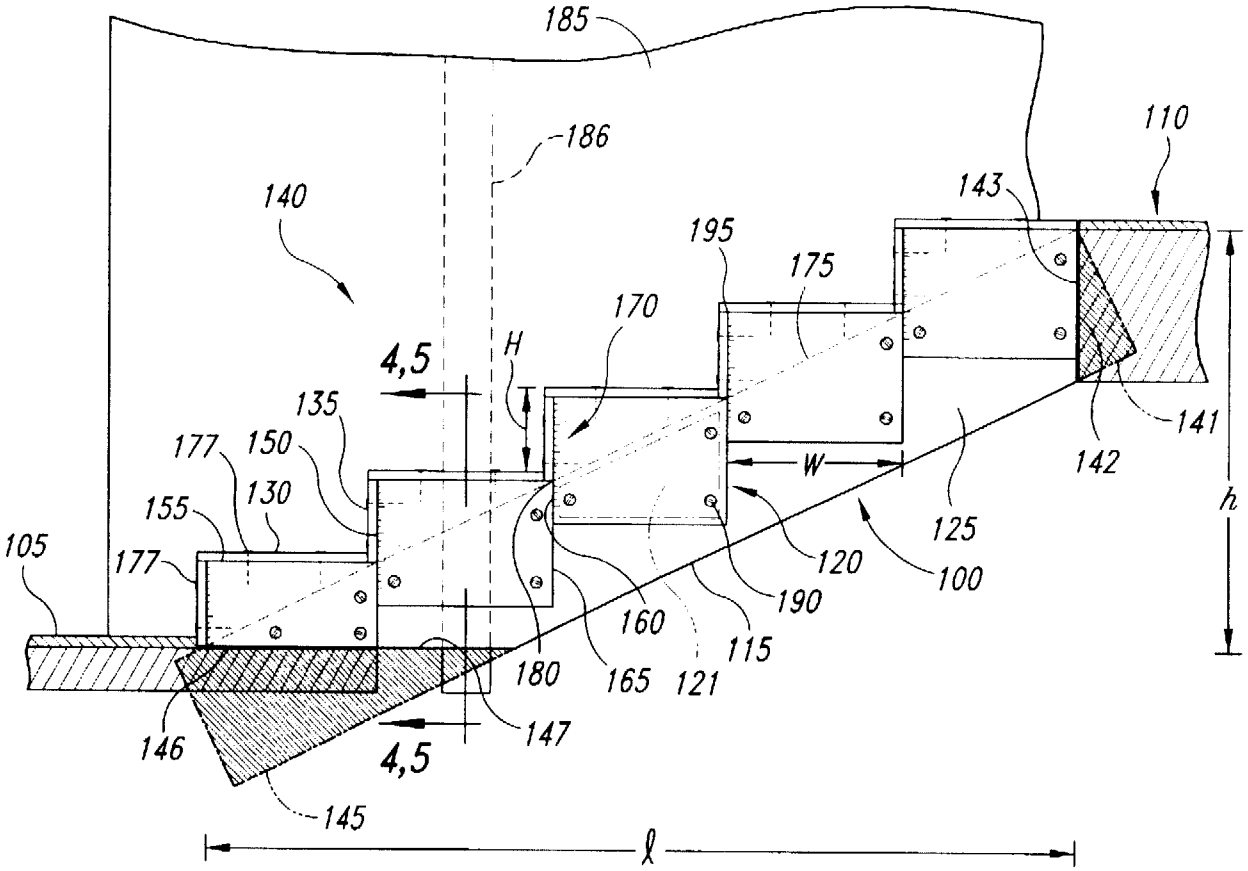
FIG. 3 is a side view of an embodiment of a stair jack in accordance with the invention.

FIG. 2 is an isometric view of an embodiment of a stair jack 100 for constructing a staircase 140 between a first surface 105 and a second surface 110, and FIG. 3 is a side view of the stair jack 100 shown in FIG. 2. In the embodiment shown in FIGS. 2 and 3, the stair jack 100 includes a plurality of stair support members or stringers 115 (only one shown in FIG. 3) extending at a selected angle between the first and second surfaces 105 and 110. The stair jack 100 also has a plurality of tread supports 120 affixed to an inner face 125 of each stringer 115, and each tread support 120 is adapted to support a stair tread 130 and retain a riser 135 (shown in phantom in FIG. 2). The stair treads 130 and risers 135 may extend between two wall panels 185 (as shown in FIG. 2), but the stair jack 100 may also be used to construct a free-standing stairway independent from any wall panels (not shown).

As shown in FIGS. 2 and 3, the stringer 115 may extend generally diagonally between the first surface 105 and the second surface 110. The stringer is preferably constructed from a single wood plank, such as a 2×8, 2×10, or 2×12. In alternate embodiments, the stringer 115 is made from a plastic, a metal or other sufficiently strong material. To shape the stringers 115 to fit in a specific application, a lower portion 145 of each stringer 115 (shown shaded in FIG. 3) may be removed to create a substantially horizontal surface 146 that abuts a horizontal portion 147 of the first surface 105. Similarly, an upper portion 141 of the stringer 115 (also shown shaded in FIG. 3) may be removed to create a substantially vertical surface 142 that abuts against an adjoining vertical surface 143 of the second surface 110. The ends of the stringers 115 may accordingly be securely affixed to both the first surface 105 and the second surface 110. In other embodiments, the stringers 115 may be shaped differently to be securely affixed to other types of structures.

In a preferred embodiment, two stringers 115 are positioned between the first and second surfaces 105 and 110, as shown in FIG. 2. Additional stringers are used in alternate embodiments where, for example, the staircase 140 is required to carry heavy loads or the width and length of the staircase are quite large. In the embodiment shown in FIG. 2, the stringers 115 have a top edge 175 that abuts lower edges 187 of adjacent wall panels 185, which are typically formed from sheet rock, dry wall or other conventional materials. The stringers 115 may be attached to studs 186 with nails, screws or other conventional attachment means that pass through the stringers 115 and into the studs 186.

After the stringers 115 are cut to fit between the first and second surfaces 105 and 110, the tread supports 120 are attached to the stringers 115 to provide surfaces to which the stair treads 130 and the risers 135 may be affixed. Each tread support 120 has an attachment element 121 adapted to be affixed to a stringer 115, a riser surface or riser element 150 adapted to hold a riser 135, and a tread mounting surface or tread element 155 adapted to support a stair tread 130. The attachment element 121 is generally defined by a lower portion of the tread support 120 that may be attached to the stringer 115 so that at least a portion of the tread element 155 is positioned above the top edge 175 of the riser 150. When the tread support 120 is a block, for example, the attachment element 121 is a lower portion of the block, the riser element 150 extends upwardly from a lower point of the attachment element 121, and the tread element 155 extends from an upper point of the riser element 150 to an upper point of the attachment element 121. Accordingly, the attachment element 121 may be configured to attach the tread support 120 to a stringer 115 so that at least a portion of the riser element 150 extends above the top edge 175 of the stringer 115 for a desired step height, and so that at least a portion of the tread element 155 is positioned above the top edge 175 of the stringer 155 to support a stair tread 130 having a desired tread width.

To lay out a stairway in a typical application, the number of tread supports 120 and the riser height H of each step is determined to provide both a minimum tread width W and a uniform riser height H for each step. Referring to FIG. 3, for example, the number of stairs is usually a function of the horizontal dimension l and the required stair width W of the local building code. Accordingly, the only variable that can be adjusted to fit the number of stairs uniformly within the staircase is the riser height H between the steps. A contractor, therefore, must determine the riser height H required to provide a uniform step height for the vertical dimension h of the staircase.

In a preferred embodiment, the tread supports 120 have tread elements 155 with a width W equal to the required stair width of the local building code to ensure that the stair treads 130 are uniform between the first surface 105 and the second surface 110. Also, to simplify the layout and construction of the stair jack 100, each tread support 120 may have markings 170 along a forward edge 160 of the riser surface 150 to indicate the riser height of each stair. The markings 170 provide a guide so that an operator may quickly and accurately position the tread blocks 120 on the stringers 115 at the desired riser height H. In an alternate embodiment (not shown) the lower edge of tread supports 120 may be cut at the desired riser height H. Thus, when a front, lower corner of a tread support 120 is adjacent to the upper surface 175 of the stringer 115, the tread element 155 of the tread support 120 is at the selected distance above the upper surface 175. In this alternate embodiment, the amount of material required to construct each tread support 120 is minimized and the need for markings is eliminated.

In a preferred embodiment shown in FIG. 3, the tread supports 120 may be positioned adjacent each other such that the forward edge 160 of one tread support abuts an aft edge or positioning edge 165 of an adjacent tread support. The riser surface 150 of one tread support 120 and the tread mounting surface 155 of an adjacent, lower tread support accordingly form a corner 180 that may be positioned at or above the top edge 175 of the stringer 115. As a result, each stair tread 130 may extend beyond the tread support 120 to an adjacent wall panel 185 or a kick board.

Figure 4:
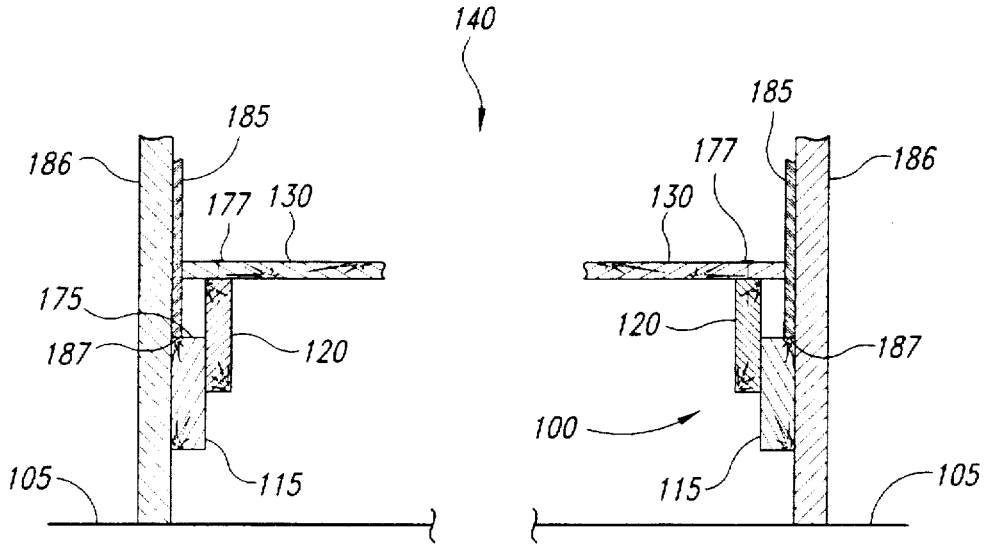
FIG. 4 is a cross-sectional view of the stair jack of FIG. 3 along line 4—4.
Figure 5:
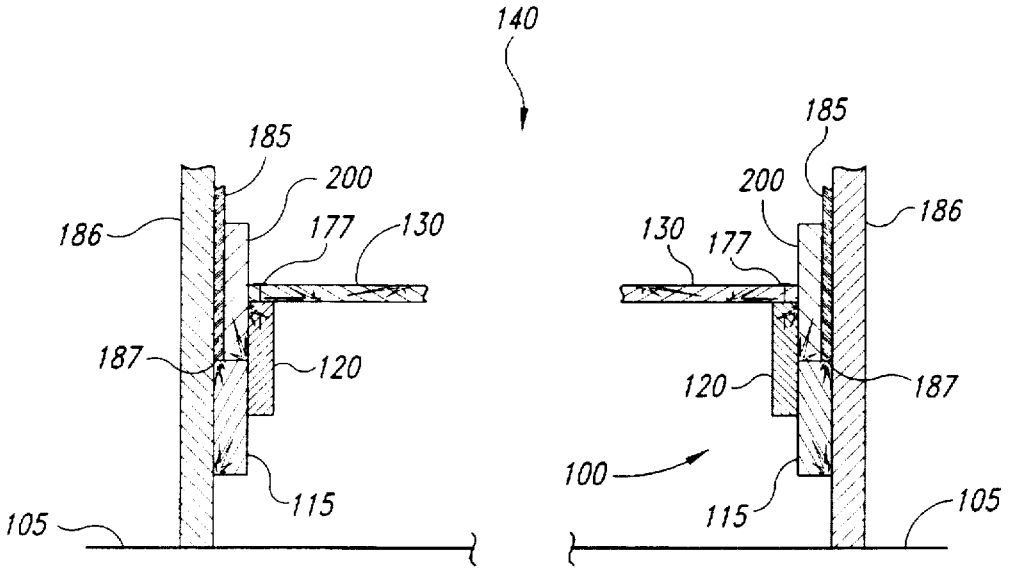
FIG. 5 is a cross-sectional view of another embodiment of a stair jack in accordance with the invention in which kickboards are positioned between stringers of the stair jack and walls adjacent to the stair jack.

One advantage of an embodiment of a stair jack 100 is that the stair treads 130 extend beyond the tread supports 120 and stringers 115 so that the wall panels or kick boards abut the stair treads 130. As best shown in FIG. 4, for example, the stair tread 130 abuts the wall panel 185 so as to visually shield the tread support 120 and the stringer 115 when viewed from above. Similarly, in an alternative embodiment shown in FIG. 5, the stair treads 130 may abut a kick board 200. The risers 135 may also abut the wall panel 185 or kick board 200 so that the risers 135 and stair treads 130 together completely shield the tread supports 120 and stringers 115 from view. Thus, by mounting the tread supports 120 to the stringers 115 so that the riser elements 150 and tread elements 155 are positioned above the stringers 115, aesthetically pleasing (e.g., hardwood) treads 130, risers 135 and kick boards 200 may be mounted to the tread supports in a manner that completely covers the stringers 115 and tread supports 120.

Another advantage of an embodiment of the present invention is that a universal tread support 120 may be manufactured for each tread width W. By providing the markings 170 along the forward edge 160 of each tread support 120, a single size of tread support 120 may be manufactured to supply the needs for most staircase installations. It will be appreciated that reducing the types of tread supports 120 required for construction of the stair jacks reduces the cost of manufacturing and maintaining an inventory of tread supports.

Still another advantage of an embodiment of the present invention is that the stringers are not notched to accommodate the stair treads 130 and risers 135. Notching the stringers compromises the strength of the stringers and/or requires that the stringers be made of heavier material to prevent the stringers from failing during normal use. Thus, less expensive 2×6 stringers may be used in many applications instead of conventional notched 2×12 stringers.

Figure 6:
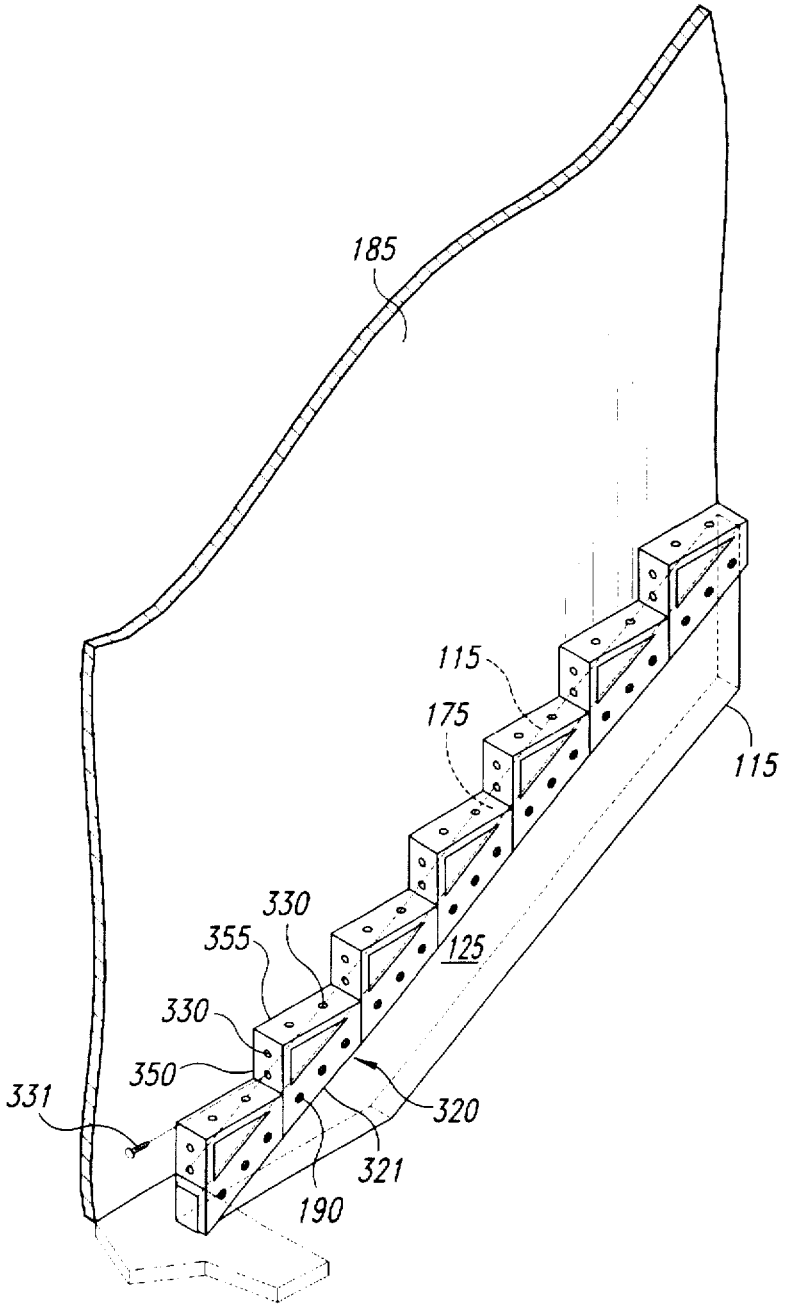
FIG. 6 is an isometric view of another embodiment of a stair jack in accordance with the invention in which a tread support has a bracket attached to a stringer.

FIG. 6 is an isometric view of still another embodiment of the invention in which a tread support 320 is a bracket with an attachment element 321 that abuts the inner face 125 and the upper surface 175 of the stringer 115. The attachment element 321 may be attached to the stringer 115 with screws 190 or other types of fasteners. As discussed above, each tread support 320 also has a tread mounting surface or tread element 355 adapted to engage a stair tread (not shown), and a riser surface or riser element 350 adapted to engage a riser (not shown). The tread support 320 is preferably made from metal, such as sheet metal. The stair tread and riser may be attached to the tread mounting surface 155 and riser surface 150, respectively, with screws 331 threaded into mounting holes 330. In a preferred embodiment, the stair tread and riser abut the wall panel 185 so as to shield the stringer 115 and tread support 320 from view.

From the foregoing, it will be appreciated that although embodiments of the invention have been described herein for purposes of illustration, various modifications may be made without deviating from the spirit and scope of the invention. For example, instead of a vertical riser surface 150 (as shown in FIG. 3), the angle between the riser surface 150 and tread mounting surface 155 may be an angle other than 90°. Additionally, the forward corner 195 (shown in FIG. 3) between the tread mounting surface 155 and the riser surface 150 may have rounded or other aesthetically appealing shapes. In still other embodiments, the stair jacks 100 may be used in an open staircase without wall panels 185 or kickboards 200 (e.g., an outdoor deck stairway), or the tread supports 120 may be affixed to an outside surface 205 (shown in FIG. 2) of the stringers. Accordingly, the invention is not limited except by the following claims.

I claim:

1. A stairjack, comprising:

a stair support member having a top inclined edge surface with a length sufficient to extend between a first surface and a second surface an exterior side for facing toward a wall, and an interior side for facing toward another stair support member; and a plurality of tread supports fixedly attached to only one of the exterior side or the interior side of the stair support member, each tread support having a riser surface projecting upwardly from the top inclined edge of the stair support member and a tread mounting surface extending from an upper point of the riser surface to the top inclined edge surface of the stair support member so that at least a portion of the tread mounting surface is above the top inclined edge surface of the stair support member to support a stair tread, wherein the tread mounting surfaces of the tread supports extend away from the side to which the tread supports are attached to leave open an area above the top inclined edge surface of the stair support member.

2. The stair jack of claim 1 wherein the tread support has a plurality of markings at selected locations adjacent to the riser surface for positioning the tread mounting surface in a selected position relative to the stair support member.

3. The stair jack of claim 1 wherein each tread mounting surface is substantially horizontal when each tread support is attached to the stair support member and the stair support member is positioned between the first and second surfaces.

4. The stair jack of claim 1 wherein each tread support further comprises a bottom surface opposite the tread mounting surface so that the tread mounting surface of one tread support is adjacent to the bottom surface of an adjacent tread support.

5. The stair jack of claim 1 wherein the tread mounting surface and the riser surface are substantially perpendicular to each other.

6. The stair jack of claim 1 wherein the tread support is a wooden block.

7. The stair jack of claim 1 wherein the riser surface of each tread support is adapted to engage a riser and the tread mounting surface of each tread support is adapted to engage a stair tread such that the riser and the stair tread extend over the stair support member and the tread support to substantially shield the stair support member and the tread support from view.

8. A stairway, comprising:

a first stair support member adjacent to a first wall surface, the first stair support member having a first top inclined edge surface with a first length sufficient to extend between a first surface and a second surface a first exterior side facing toward the first wall and a first interior side;

a second stair support member adjacent to a second wall surface, the second stair support member having a second top inclined edge surface with a second length sufficient to extend between the first and second surfaces a second exterior side facing toward the second wall, and a second interior side for facing toward the first interior side;

a first tread support attached to only the first interior side of the first stair support member, the first tread support having a first riser surface projecting upwardly from the first top inclined edge surface of the first stair support member and a first tread mounting surface extending from an upper point of the first riser surface to the first top inclined edge surface so that at least a portion of the first tread mounting surface is above the first top inclined edge surface when the first tread support is attached to the first stair support member, wherein the first tread mounting surface extends away from the first interior side of the first stair support member to leave open an area above the first top inclined edge surface of the first stair support member;

a second tread support attached to only the second interior side of the second stair support member, the second tread support having a second riser surface projecting upwardly from the second top inclined edge surface of the second stair support member and a second tread mounting surface extending from an upper point of the second riser surface to the second top inclined edge surface so that at least a portion of the second tread mounting surface is above the second top inclined edge surface when the second tread support is attached to the second stair support member, wherein the second tread mounting surface extends away from the second interior side of the second stair support member to leave open an area above the second top inclined edge surface of the second stair support member;

a stair tread attached to the first and second tread mounting surfaces of the first and second tread supports; and a riser attached to the first and second riser surfaces of the first and second tread supports.

9. The stairway of claim 8 wherein the stair tread has a first end adjacent to the first wall and a second end adjacent to the second wall.

10. The stairway of claim 8 wherein the riser has a first end adjacent to the first wall and a second end adjacent to the second wall.

11. The stairway of claim 8 wherein the stair tread has an end portion adjacent to the first wall and a second end adjacent the second wall and the riser has a first end adjacent to the first wall and a second end adjacent to the second wall, the riser and stair tread shielding the first and second stair support members and the first and second tread supports from view.

12. The stairway of claim 8 wherein the first stair support member has a first kickboard, the first kickboard being adjacent the first wall and the second stair support member has a second kickboard, the second kickboard being adjacent the second wall.

13. A method for constructing a staircase, comprising:

attaching a plurality of tread supports to only an interior side of a stair support member such that a riser surface of each tread support projects upwardly from a top inclined edge surface of the stair support member and a tread support surface extends from an upper point of the riser surface toward the top inclined edge and away from the interior side of the support member to leave open an area above the top inclined edge surface of the stair support member, the riser surface being adapted to engage a riser and the tread mounting surface being adapted to engage a stair tread; and positioning a stair support member between a first surface and a second surface.

14. The method of claim 13, further comprising:

mounting a stair tread to each tread support surface; and connecting a riser to each riser surface to form a staircase in which the tread supports and stair support members are hidden from view.

* * * * *